United States Patent [19]

Baird

[11] Patent Number: 4,765,360

[45] Date of Patent: Aug. 23, 1988

[54] WATER HEATER LEAK COLLECTOR

[76] Inventor: Willard J. Baird, Box 54, Broadview, Mont. 59015

[21] Appl. No.: 85,158

[22] Filed: Aug. 14, 1987

[51] Int. Cl.[4] ..... F24H 9/08; F24H 9/16

[52] U.S. Cl. ..... 137/312; 126/363; 222/108; 248/346.1

[58] Field of Search ..... 126/350 R, 361, 363; 4/252 A, 613, 640, 641, 661; 137/312, 360; 222/108; 248/346, 346.1

[56] References Cited

U.S. PATENT DOCUMENTS

| | | | |
|---|---|---|---|
| 1,017,167 | 2/1912 | Pleins | 4/613 |
| 1,038,021 | 9/1912 | Summers | 222/108 |
| 2,199,481 | 5/1940 | Chappell | 126/363 UX |
| 2,206,694 | 7/1940 | Greene | 248/346.1 |
| 2,328,245 | 8/1943 | Yavitch | 126/363 |
| 2,781,651 | 2/1957 | Cutler | 248/346.1 |
| 3,069,671 | 12/1962 | Taylor | 137/312 |
| 3,606,617 | 9/1971 | Frazier | 4/613 |
| 3,800,335 | 4/1974 | Buonaura | 4/613 |
| 3,821,426 | 6/1974 | Slone | 248/346 |
| 3,895,398 | 7/1975 | Mustee | 4/613 |

FOREIGN PATENT DOCUMENTS

| | | | |
|---|---|---|---|
| 298300 | 6/1971 | Fed. Rep. of Germany | 248/346.1 |
| 2222970 | 11/1973 | Fed. Rep. of Germany | 248/346 |
| 7510537 | 3/1977 | Netherlands | 126/363 |

*Primary Examiner*—George L. Walton

*Attorney, Agent, or Firm*—Richard C. Litman

[57] ABSTRACT

An auxiliary appliance for collecting water that leaks from a water heater and the like that is mounted thereon. This device includes a collector base that has an upper surface, a lower surface, and a thin, strip wall that extends, in an upright fashion, along the periphery of the collector base. A plurality of appliance supports and a plurality of collector base supports are arrayed and affixed to the upper collector surface and lower collector surface, respectively. The device contains a collector base orifice disposed therein and is connected to a draining means, such that water received from a target appliance is removed, flowing out of the device to a suitable drain.

8 Claims, 1 Drawing Sheet

WATER HEATER LEAK COLLECTOR

FIELD OF INVENTION

The present invention relates to those devices for collecting water leaking from an appliance, such as a water heater, and conveniently and expeditiously disposes of that waste water.

BACKGROUND TO THE INVENTION

The present invention relates to water collecting devices, and, more particularly, to those devices that are auxiliary to, or used in conjunction with, major appliances such as water heaters. The apparatus, as disclosed herein, relates to those auxiliary devices for the collection of water that leaks from the major appliance, conveying this water to a suitable drain facility.

The present device also relates to those apparatuses for the protection of flooring, carpeting, and other structural and/or ornamental floor coverings, such that defective or malfunctioning appliances do not damage the underlying structure or floor-coverings.

Further, the present device relates to those devices for the convenient maintenance of major appliances, such as refrigerators and water heaters so that they may be safely and expeditiously drained of water, as needed, without harm to flooring or carpets and surrounding structures; and further, that these appliances may be drained, for repair or routine maintenance in a manner easy and convenient for the user of the device.

DESCRIPTION OF THE PRIOR ART

The following cited references are found to be exemplary of the U.S. prior art. They are:

| U.S. Pat. No. | Inventor |
|---|---|
| 875,944 | Nash |
| 1,057,654 | Menzl |
| 4,633,899 | Loro |

U.S. Pat. No. 875,944, issued to Nash, discloses a pan for catching the drip water from refrigerators. The object of this invention is to provide a collector for water so the drops will not damage the floor and carpeting.

U.S. Pat. No. 1,057,654, issued to Menzl, teaches a pan for the drip water from refrigerators. This pan is constructed in such a way that when filled water, it automatically moves into a position visible to any person in the vicinity.

U.S. Pat. No. 4,633,899, issued to Loro, discloses a rectangular plastic sheet with four corners that is fastened to the ceiling to temporarily collect leaking water. A light plastic tube is connected to the center of the sheet to drain the water to an outside location.

SUMMARY OF THE INVENTION

A primary object of the present apparatus is to provide a collector for leaking water, such that the collected water is expeditiously siphoned off to a drain facility.

Another object of the present invention is to provide for continuous drainage of water away from a leaking appliance to protect the floor and floor coverings from possible overspill of water that would otherwise accumulate in or about the device.

A further object of the device is to provide a means for elevating the major appliance, such that the collecting device offers a virtual one hundred percent efficient receptacle for free and capillary water draining off the major appliance.

A still further object is to provide a device substantially capable of moving water, in a catastrophic accident, away from the major appliance, keeping free-flowing water, off the underlying floor and away from surrounding furnishings.

DESCRIPTION OF THE PREFERRED EMBODIMENT

Figure 1:
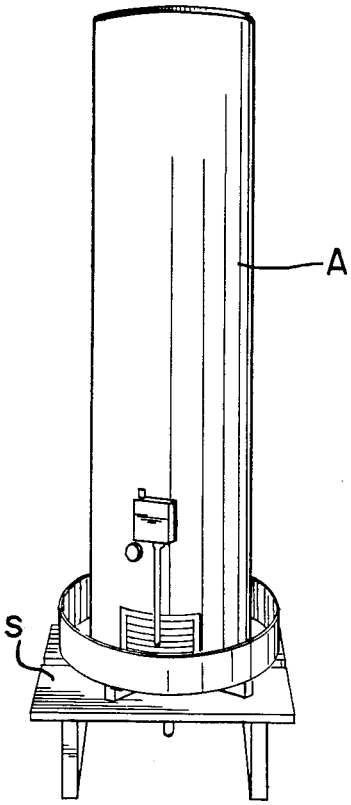
FIG. 1 is an elevational view showing the device in use.
Figure 2:
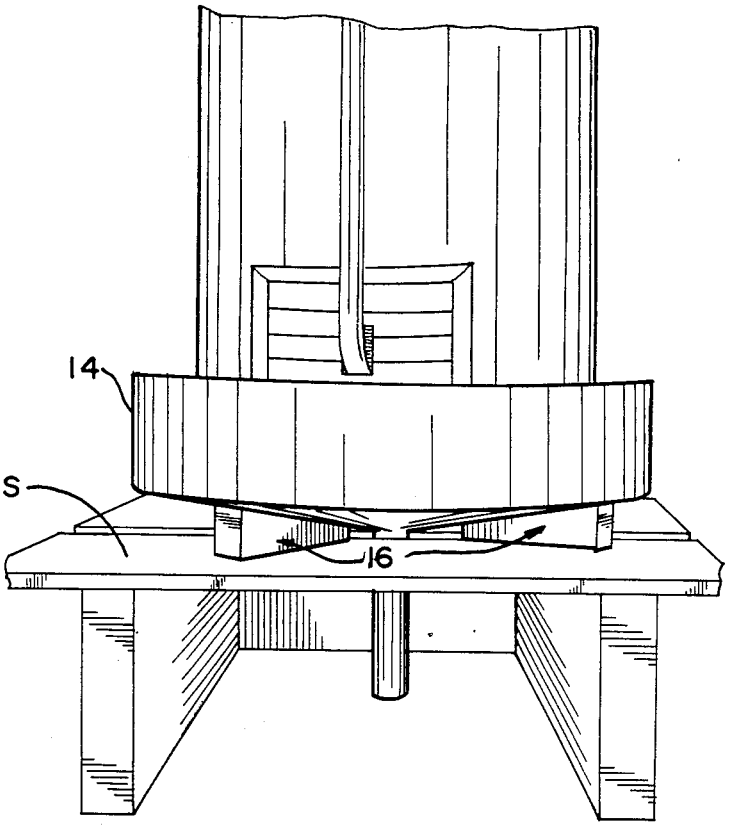
FIG. 2 is an enlarged view, showing a typical installation.

Referring now to FIGS. 1 through 4, the device 10 includes a cylindrical collector base 12 which may be manufactured of plastics, metal or any suitable materials. The collector base 12 will be seen to be slightly dished towards its center opening 22 and includes a peripheral wall 14 that extends vertically above the outer edge of the collector base 12 and surrounds it circumferentially.

Figure 3:
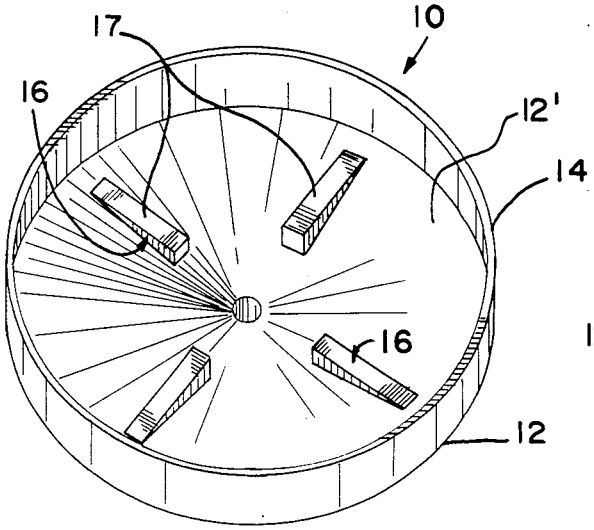
FIG. 3 is a top view of the device.

A plurality of appliance supports 16 are affixed and arrayed on an upper surface 12′ of the collector base 12, such that an appliance mounted thereon will be elevated or kept separated from the upper surface 12′ of the collector base itself. The supports 16 are preferably equispaced such as shown in FIG. 3 and include a planar upper surface 17.

Beneath the collector base lower surface 12″ the supports 16 will be seen to provide a plurality of planar collector base lower surfaces 18 affixed such that the collector base is elevated, and kept separate from the underlying relative stationary floor or other structures on which the device is resting.

The downwardly sloping nature of the base upper surface 12′ collects and directs all collected leak water to the central orifice 22, which in turn is connected to a drain line 24. Drain line 24 carries away leak water to any suitable water drain facility.

Collector base supports 18 are beveled and arrayed radially on the lower surface 12″ of collector base 12, such that as base collector 12 is positioned substantially under the target appliance A, collector supports 18 may be rotated to level the device on the floor, even if the floor itself has a slight slope or grade to it; thus, the device assists in leveling a target appliance mounted on it.

Figure 4:
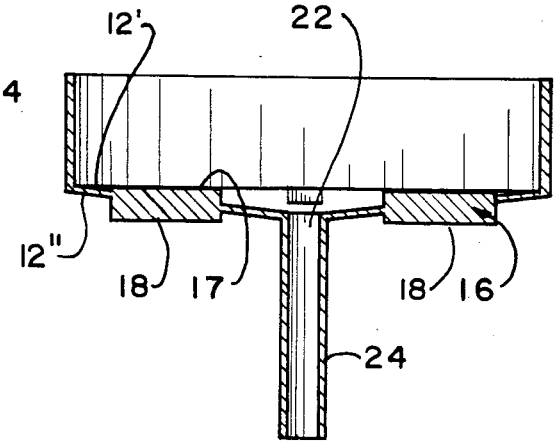
FIG. 4 is a sectional view of the device of FIG. 3, illustrating typical operation and means for draining water.

As shown most clearly in FIG. 4 of the drawing, each associated appliance and collector support preferably comprises an integral member passing through the body of the collector base. With this construction, an appliance A of substantial weight may be readily accommodated in a stable manner, even if the remaining collector structure is manufactured of relative lightweight material, such as of plastics.

With the above construction, it will be seen that the planar and parallel upper and lower surfaces 17,18 of the support members 16, although horizontally disposed, are spaced from and inclined relative the respective upper and lower surfaces 12,12" of the collector base. In this manner, the collector base is at all times free and clear of both the supported appliance A as well as the underlying support structure S.

It can be seen from the foregoing that the objects and advantages of the present device have been accomplished and while some small changes will occur to those skilled in the art, the foregoing should be considered as illustrative only of the apparatus. Therefore, all equivalents thereof fall under the scope of invention, the limitations thereof residing only in the claims as contained herein.

I claim:

1. In a water leak collecting apparatus for appliances such as a water heater or the like and adapted to be mounted atop an underlying support surface, the improvement comprising:

a collector member including a base having a centrally disposed opening, a peripheral wall bounding said base and extending upwardly therefrom, inclined upper and lower faces on said base extending downwardly and inwardly from said peripheral wall toward said opening, a plurality of separate unitary spaced apart support elements extending through said base and spaced from said peripheral wall, each said support element including an upper surface disposed above said base inclined upper face and an integral lower surface disposed in a plane beneath said base inclined lower face, whereby following disposition of said plurality of support element lower surfaces upon an underlying support surface, an appliance disposed atop said support element upper surfaces is fully and directly supported by engagement of said support elements upon the underlying surface without said base being supported by its underlying support surface.

2. A water leak collecting apparatus according to claim 1 wherein, said plurality of support elements are radially disposed relative said central opening.

3. A water leak collecting apparatus according to claim 1 wherein, said plurality of support elements are angularly equispaced from one another.

4. A water leak collecting apparatus according to claim 1 including, a drain tube joined to said central opening.

5. A water leak collecting apparatus according to claim 1 wherein, said support element upper and lower surfaces are horizontally disposed.

6. A water leak collecting apparatus according to claim 5 wherein, said support element surfaces are planar.

7. A water leak collecting apparatus according to claim 1 wherein, said upper and lower surfaces of each said support element are vertically aligned relative one another.

8. A water leak collecting apparatus according to claim 1 wherein, said base and peripheral wall are circular and, said support elements are spaced radially inwardly of said peripheral wall.

* * * * *